US011700896B2

(12) United States Patent
Harris

(10) Patent No.: US 11,700,896 B2
(45) Date of Patent: Jul. 18, 2023

(54) UPPER BODY GARMENT WITH ENHANCED MOBILITY PORTIONS

(71) Applicant: NIKE, Inc., Beaverton, OR (US)

(72) Inventor: Donavan Harris, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 33 days.

(21) Appl. No.: 17/146,069

(22) Filed: Jan. 11, 2021

(65) Prior Publication Data

US 2021/0244116 A1 Aug. 12, 2021

Related U.S. Application Data

(60) Provisional application No. 62/971,022, filed on Feb. 6, 2020.

(51) Int. Cl.
*A41D 27/10* (2006.01)
*A41D 31/10* (2019.01)

(52) U.S. Cl.
CPC ..... *A41D 27/10* (2013.01); *A41D 31/10* (2019.02)

(58) Field of Classification Search
CPC ..... A41D 27/10; A41D 27/28; A41D 15/007; A41D 15/00; A41D 27/04; A41D 1/02; A41D 2400/70; A41D 3/00; A41D 27/02; A41D 1/04; A41D 3/02; A41D 3/04; A41D 31/02
USPC ..... 2/126
See application file for complete search history.

(56) References Cited

U.S. PATENT DOCUMENTS 422,669 A 3/1890 Upthegrove
483,686 A 10/1892 Goodman
2,322,510 A * 6/1943 Dufine ..... A41D 27/04 2/97
2,364,066 A 12/1944 Jerome
2,457,356 A 12/1948 Enck
2,458,004 A 1/1949 Kerr
2,514,276 A 7/1950 Berman
3,049,719 A 8/1962 Hyman
3,719,956 A 3/1973 Glassberg
(Continued)

FOREIGN PATENT DOCUMENTS

EP 2727485 B1 11/2015
GB 26840 5/1913
(Continued)

OTHER PUBLICATIONS

International Search Report and Written Opinion received for PCT Patent Application No. PCT/US2021/013861, dated Apr. 26, 2021, 13 pages.
Men's Shifter Shirt, Available online at: <www.mastgeneralstore.com>, Sep. 11, 2019, 4 pages.
Men's Short Sleeve T-shirt Cool Dry Compression Top Muscle Gym Bodybuilding Shirts With Cover Sleeves, Available online at: <www.amazon.com>, Sep. 11, 2019, 3 pages.
(Continued)

*Primary Examiner* — Sally Haden
*Assistant Examiner* — Grady Alexander Nunnery
(74) *Attorney, Agent, or Firm* — Shook, Hardy & Bacon L.L.P.

(57) ABSTRACT

The present invention relates to upper body garments designed to provide an enhanced range of motion to the arms and shoulders of a wearer. This is accomplished by having a layered construction comprising different fabric/textile materials where the enhanced range of motion is desired. In aspects, the upper body garment includes an inner sleeve and an outer sleeve where the garment is structured so that the outer sleeve is decoupled from the inner sleeve in one or more locations.

20 Claims, 9 Drawing Sheets

(56) References Cited

U.S. PATENT DOCUMENTS

| | | | | |
|---|---|---|---|---|
| 4,554,682 | A | 11/1985 | Hillquist | |
| 4,864,655 | A | 9/1989 | Mckenney et al. | |
| 4,999,850 | A | 3/1991 | Grilliot et al. | |
| 5,093,934 | A | 3/1992 | Dillon, Jr. | |
| 7,849,522 | B2 | 12/2010 | Roux | |
| 8,973,168 | B2 | 3/2015 | Amburgey | |
| 10,165,813 | B2 | 1/2019 | Martin | |
| 10,219,554 | B2 | 3/2019 | Farron et al. | |
| 10,258,096 | B2 | 4/2019 | Walrich et al. | |
| 2003/0167551 | A1* | 9/2003 | Findlay | A41D 31/102 2/93 |
| 2004/0064869 | A1 | 4/2004 | Deadwyler | |
| 2013/0097763 | A1* | 4/2013 | Lewis | A41D 3/00 2/69 |
| 2014/0201883 | A1 | 7/2014 | Achtymichuk | |
| 2016/0050994 | A1 | 2/2016 | Bushby et al. | |
| 2017/0251733 | A1 | 9/2017 | Sorrentino | |
| 2019/0133216 | A1* | 5/2019 | Durham | A41D 31/185 |

FOREIGN PATENT DOCUMENTS

| | | | | | |
|---|---|---|---|---|---|
| JP | 3167570 | U | | 4/2011 | |
| KR | 20110001871 | U | * | 2/2011 | A41D 27/20 |
| WO | 2007/004326 | A1 | | 1/2007 | |
| WO | 2018/075898 | A1 | | 4/2018 | |

OTHER PUBLICATIONS

Pacifico Performance Short Sleeve, AVID, Available online at: <www.avidgear.com>, Sep. 11, 2019, 2 pages.

WearGuard Convertible Jacket, Item GGS-13217, Aramark, Available online at: <www.aramarkuniform.com>, Sep. 11, 2019, 1 page.

Women's Poly-flex Jacket, The Weather Apparel Company, Performance Outerwear, Rain Wear & Umbrellas, Available online at: <https://theweatherapparelco.com>, Sep. 11, 2019, 5 pages.

International Preliminary Report on Patentability received for PCT Patent Application No. PCT/US2021/013861, dated Aug. 18, 2022, 9 pages.

* cited by examiner

UPPER BODY GARMENT WITH ENHANCED MOBILITY PORTIONS

CROSS-REFERENCE TO RELATED APPLICATIONS

This U.S. Non-Provisional application Ser. No. 17/146,069, filed on Jan. 11, 2021 and entitled "Upper Body Garment with Enhanced Mobility Portions," claims the benefit of priority of U.S. Provisional Application No. 62/971,022, filed on Feb. 6, 2020 and entitled "Upper Body Garment With Enhanced Mobility Portions," the entirety of which is incorporated by reference herein.

TECHNICAL FIELD

The present invention relates to apparel that provides an enhanced range of motion to the arms and shoulders of a wearer when the apparel is worn.

BACKGROUND

Weather often requires a person to wear extra layers of clothing when outdoors. The extra layers of clothing may be constrictive and, for example, reduce the range of motion of the arms and shoulders of a wearer, especially when engaging in an athletic activity.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An upper body garment comprising: an outer front panel and an outer back panel forming an outer torso portion of the upper body garment, the outer front panel and the outer back panel including an outer sleeve opening edge; an inner front panel and an inner back panel forming an inner torso portion of the upper body garment, the inner front panel and the inner back panel including an inner sleeve opening edge; and a sleeve assembly comprising: an inner sleeve having an inner sleeve proximal end and an inner sleeve distal end, the inner sleeve proximal end attached to the inner sleeve opening edge, and an outer sleeve having an outer sleeve proximal end and an outer sleeve distal end, the outer sleeve proximal end attached to a front upper edge of the outer front panel and to a back upper edge of the outer back panel, wherein the outer sleeve proximal end is detached from the outer sleeve opening edge.

Clause 2. The upper body garment according to clause 1, wherein the inner sleeve distal end is attached to the outer sleeve distal end.

Clause 3. The upper body garment according to any of clauses 1 through 2, wherein the inner sleeve includes an intermediate sleeve portion that exhibits a stretch characteristic, wherein the intermediate sleeve portion is spaced apart from the inner sleeve proximal end and the inner sleeve distal end.

Clause 4. The upper body garment according to clause 3, wherein the intermediate sleeve portion includes a stretch mesh material.

Clause 5. The upper body garment according to any of clauses 1 through 4, wherein the outer torso portion and the outer sleeve are made from a water resistant or a water repellant material.

Clause 6. The upper body garment according to any of clauses 1 through 5, wherein the outer sleeve proximal end includes a non-circumferential perimeter edge.

Clause 7. The upper body garment according to any of clauses 1 through 6, wherein the outer sleeve proximal end includes an outer shoulder portion extension and an outer circumferential portion, wherein the outer shoulder portion extension attaches to the front upper edge of the outer front panel and to the back upper edge of the outer back panel, and wherein the outer circumferential portion is detached from the outer sleeve opening edge.

Clause 8. The upper body garment according to any of clauses 1 through 7, wherein the inner sleeve proximal end includes an inner shoulder portion extension and an inner circumferential portion, wherein the inner shoulder portion extension attaches to a front upper edge of the inner front panel and to a back upper edge of the inner back panel, and wherein the inner circumferential portion is attached to the inner sleeve opening edge.

Clause 9. The upper body garment according to any of clauses 1 through 8, wherein the inner sleeve includes an upper sleeve portion extending from the inner sleeve proximal end, a lower sleeve portion extending from the inner sleeve distal end, and an intermediate sleeve portion positioned between the upper sleeve portion and the lower sleeve portion, wherein the intermediate sleeve portion has a greater stretch characteristic than the upper sleeve portion.

Clause 10. The upper body garment according to clause 9, wherein the outer torso portion, the outer sleeve, and the upper sleeve portion of the inner sleeve are made from a water resistant or a water repellant material.

Clause 11. An upper body garment comprising: a torso portion having a front panel and a back panel cooperating to form a first sleeve opening having a first sleeve opening edge; and a first sleeve assembly comprising: a first inner sleeve having a first inner sleeve proximal end and a first inner sleeve distal end, the first inner sleeve proximal end attached to the first sleeve opening edge, and a first outer sleeve having a first outer sleeve proximal end and a first outer sleeve distal end, the first outer sleeve proximal end including a first outer shoulder portion extension and a first outer circumferential portion, the first outer shoulder portion extension attached to a first shoulder area of the torso portion, and the first outer circumferential portion being fully detached from the first sleeve opening edge.

Clause 12. The upper body garment according to clause 11 further comprising: a second sleeve assembly comprising: a second inner sleeve having a second inner sleeve proximal end and a second inner sleeve distal end, the second inner sleeve proximal end attached to a second sleeve opening edge of a second sleeve opening of the torso portion; and a second outer sleeve having a second outer sleeve proximal end and a second outer sleeve distal end, the second outer sleeve proximal end including a second outer shoulder portion extension and a second outer circumferential portion, the second outer shoulder portion extension attached to a second shoulder area of the torso portion, and the second outer circumferential portion being fully detached from the second sleeve opening edge.

Clause 13. The upper body garment according to any of clauses 11 through 12, wherein the first inner sleeve distal end is attached to the first outer sleeve distal end, and wherein the second inner sleeve distal end is attached to the second outer sleeve distal end.

Clause 14. The upper body garment according to any of clauses 11 through 13, wherein the second inner sleeve includes a second upper sleeve portion extending from the second inner sleeve proximal end, a second lower sleeve portion extending from the second inner sleeve distal end, and a second intermediate sleeve portion positioned between the second upper sleeve portion and the second lower sleeve portion, wherein the second intermediate sleeve portion has a greater stretch characteristic than the second upper sleeve portion.

Clause 15. The upper body garment according to any of clauses 11 through 14 wherein the first inner sleeve includes a first upper sleeve portion extending from the first inner sleeve proximal end, a first lower sleeve portion extending from the first inner sleeve distal end, and a first intermediate sleeve portion positioned between the first upper sleeve portion and the first lower sleeve portion, wherein the first intermediate sleeve portion has a greater stretch characteristic than the first upper sleeve portion.

Clause 16. The upper body garment according to clause 15, wherein the first intermediate sleeve portion is comprised of a stretch mesh material.

Clause 17. The upper body garment according to any of clauses 15 through 16, wherein the torso portion, the first outer sleeve, and the first upper sleeve portion are comprised of a water proof or a water repellant material.

Clause 18. The upper body garment according to any of clauses 11 through 17, wherein the front panel and the back panel of the torso portion include two or more layers of material.

Clause 19. The upper body garment according to any of clauses 11 through 18, wherein the first inner sleeve proximal end includes a first inner shoulder portion extension and a first inner circumferential portion, wherein the first inner shoulder portion extension is attached to the first shoulder area of the torso portion, and wherein the first inner circumferential portion is attached to the first sleeve opening edge.

Clause 20. A method for manufacturing an upper body garment comprising: attaching an outer front panel to an outer back panel to form an outer torso portion of the upper body garment, the outer torso portion including an outer sleeve opening edge; attaching an inner front panel and an inner back panel to form an inner torso portion of the upper body garment, the inner torso portion including an inner sleeve opening edge; attaching an inner sleeve proximal end of an inner sleeve to the inner sleeve opening edge; and attaching a shoulder portion extension of an outer sleeve proximal end of an outer sleeve to a front upper edge of the outer front panel and to a back upper edge of the outer back panel, wherein a circumferential portion of the outer sleeve proximal end is detached from the outer sleeve opening edge of the outer torso portion.

Clause 21. The method for manufacturing the upper body garment according to clause 20, further comprising attaching an inner sleeve distal end to an outer sleeve distal end.

Clause 22. The method for manufacturing the upper body garment according to any of clauses 20 through 21, wherein the inner sleeve includes an intermediate sleeve portion that exhibits a stretch characteristic, wherein the intermediate sleeve portion is spaced apart from the inner sleeve proximal end and the inner sleeve distal end.

Clause 23. The method for manufacturing the upper body garment according to clause 22, wherein the intermediate sleeve portion is comprised of a stretch mesh material.

Clause 24. The method for manufacturing the upper body garment according to any of clauses 20 through 23, wherein the outer torso portion and the outer sleeve are comprised of a water resistant or a water repellant material.

Clause 25. The method for manufacturing the upper body garment according to any of clauses 20 through 24, wherein the outer sleeve proximal end includes a non-circumferential perimeter edge.

Clause 26. The method for manufacturing the upper body garment according to any of clauses 20 through 25, wherein the inner sleeve proximal end includes an inner shoulder portion extension and an inner circumferential portion, the method further comprising attaching the inner shoulder portion extension to a front upper edge of the inner front panel and to a back upper edge of the inner back panel, and attaching the inner circumferential portion to the inner sleeve opening edge.

Clause 27. The method for manufacturing the upper body garment according to any of clauses 20 through 26, wherein the outer torso portion, the outer sleeve, and a portion extending from the inner sleeve proximal end of the inner sleeve are made from a water resistant or a water repellant material.

BRIEF DESCRIPTION OF THE DRAWINGS

The present invention is described in detail below with reference to the attached drawing figures, wherein.

DETAILED DESCRIPTION OF THE INVENTION

Figure 1B:
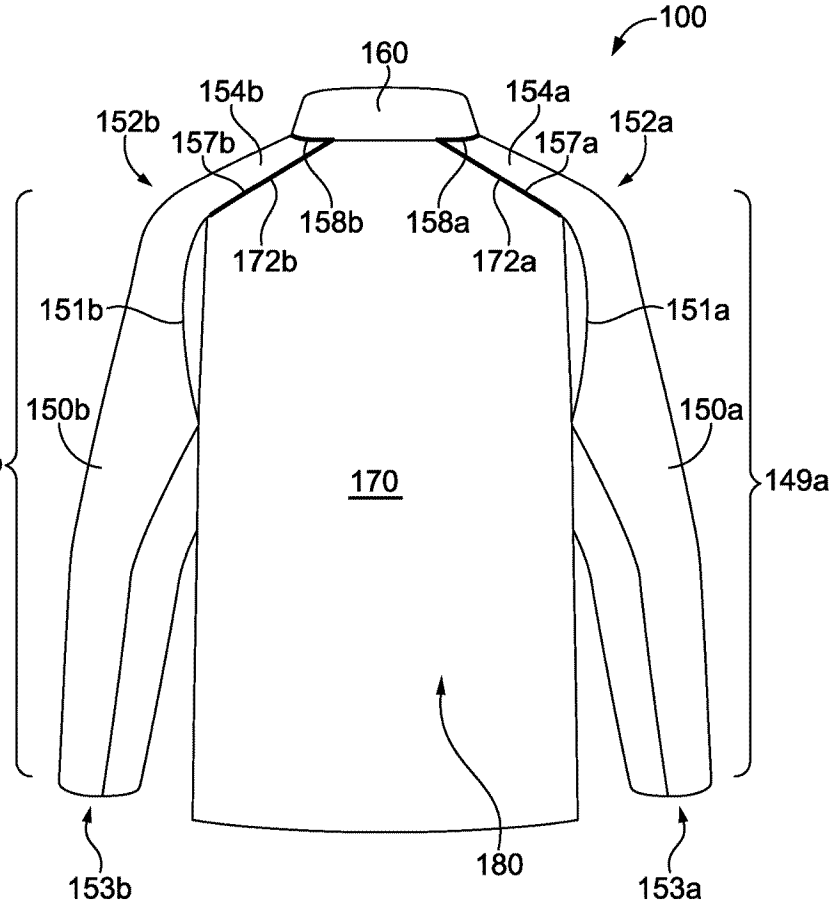
FIGS. 1A and 1B show a front and back view, respectively, of outer layers of an upper body garment, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Weather traditionally requires a person to wear extra layers of clothing when outdoors. In general, the extra layers of clothing may be constrictive and, for example, reduce the range of motion of the arms and shoulders of a wearer, especially when engaging in an athletic activity. Aspects herein provide for an upper body garment with enhanced range of motion around the shoulders and the arms achieved through the use of a sleeve construction that includes an outer sleeve that is generally decoupled from a stretchable inner sleeve. In addition to an enhanced range of motion, an additional advantage of the upper body garment is that it provides ventilation without compromising protection from environmental elements.

At a high level, the upper body garment described herein may have a layered construction, where different types of fabrics and or materials may be used in the different layers of the upper body garment to achieve a comfortable wear for the wearer without sacrificing protective aspects offered by the upper body garment. In example aspects, the upper body garment includes an outer front panel and an outer back panel forming an outer torso portion of the upper body garment, the outer front panel and the outer back panel including an outer sleeve opening edge for each sleeve. Further, the upper body garment includes an inner front panel and an inner back panel forming an inner torso portion of the upper body garment, the inner front panel and the inner back panel including an inner sleeve opening edge for each sleeve. Each sleeve of the upper body garment includes an inner sleeve and an outer sleeve. The proximal end of the inner sleeve of each sleeve is attached to the inner sleeve opening edge of the inner torso portion. The proximal end of each outer sleeve is attached to a front upper edge of the outer front panel and to a back upper edge of the outer back panel, and is detached from the respective outer sleeve opening edge. The construction thus described effectively decouples the inner sleeve from the outer sleeve and enables the inner sleeve to move and stretch independently of the outer sleeve thereby providing an enhanced range of motion in the shoulders and arms of a wearer. As well, because the proximal end of the outer sleeve is detached from the outer sleeve opening edge, a ventilation space is formed between the proximal end of the inner sleeve and the proximal end of the outer sleeve allowing, for example, heated air to exit the upper body garment.

In example aspects, the outer front panel, the outer back panel, and each outer sleeve may be formed from water repellent or water resistant textiles that are suitable to protect the wearer from weather elements such as rain, wind, snow, mist, and the like. The textiles forming the outer front panel, the outer back panel, and the outer sleeves may have minimal stretchability or elasticity in example aspects. In one aspect, the inner front panel and the inner back panel may be formed from similar or the same textiles as the outer front panel and the outer front panel. In other aspects, the inner front panel and the inner back panel may be formed from a comfort textile such as a cotton based textile, or a moisture management textile, and the like.

In example aspects, each inner sleeve is divided into two or more portions. For instance, in one aspect, each inner sleeve may include an upper sleeve portion and a lower sleeve portion. In another aspect, each inner sleeve may include an upper sleeve portion, a lower sleeve portion, and an intermediate sleeve portion positioned between the upper sleeve portion and the lower sleeve portion. In either aspect, the upper sleeve portion may be formed of the same water repellent or water resistant material as the outer front panel, the outer back panel, and the outer sleeves. The intermediate sleeve portion and/or the lower sleeve portion (particularly when there is no intermediate sleeve portion), may be formed of a highly stretchable and/or breathable textile such as a stretch mesh material. The stretchable textile may be a four-way stretchable textile, a two-way stretchable textile, a composite material, and the like. Stated differently, the modulus of elasticity of the upper sleeve portion is higher than the modulus of elasticity of the intermediate sleeve portion and/or the lower sleeve portion thus affording the inner sleeves, which are in closer contact with the wearer, the freedom to stretch as necessary with the motions of the shoulders and arms of a wearer.

Positional terms as used herein such as "proximal," "distal," "inner," "outer," "front," "back," and the like are to be given their customary meaning with respect to an appropriately-sized upper body garment worn as intended and as shown and described herein by a wearer standing in an upright position. Thus, the front of the upper body garment and/or sleeve is configured to be positioned adjacent to a front torso area of a wearer and/or a front of a wearer's arms respectively, and the back of the upper body garment and/or sleeve is configured to be positioned adjacent to a back torso area of the wearer and/or a back of a wearer's arms respectively. A proximal end of, for example, a sleeve is configured to be positioned closer to a midline (or to the torso) of the wearer as compared to a distal end of the sleeve. An inner panel or sleeve is configured to be positioned closer to a wearer's body surface than an outer panel or sleeve. In example aspects, the outer panel or sleeve is configured to be exposed to an external environment.

The term "panel" as user herein generally means a pattern piece having one or more terminal edges where one or more of the edges may be free edges or may be affixed or attached to one or more edges of a different panel. The term "edge" or "perimeter edge" means a terminal edge of a textile or material. The term "stretch characteristic" or "stretch and recovery characteristic" as used herein means the ability of a material to stretch in one or more directions in response to a tensioning force and return to its resting state when the tension is released or removed. The stretch characteristic of a material or structure may be described herein relative to the stretch characteristic of another material or structure. Thus, when a first material has a greater stretch characteristic than a second material, it means that the first material is able to stretch further in a particular direction in response to a tensioning force as compared to the second material. The term "stretch mesh material" as used herein means a material having a stretch property that includes a large number of closely spaced holes or openings formed either through an engineered knit or woven construction or through the formation of holes in a post-construction step. The stretch mesh material as used herein may exhibit a relatively high degree of air permeability compared to non-mesh materials. The terms "attach," "secure," or "affix" as used herein generally means a permanent attachment achieved through, for instance, stitching, bonding, adhesives and the like unless indicated otherwise.

Unless indicated otherwise all measurements provided herein are measured when the upper body garment is at standard ambient temperature and pressure (25 degrees Celsius or 298.15 K and 1 bar) and is in a resting or un-tensioned state.

Figure 1A:
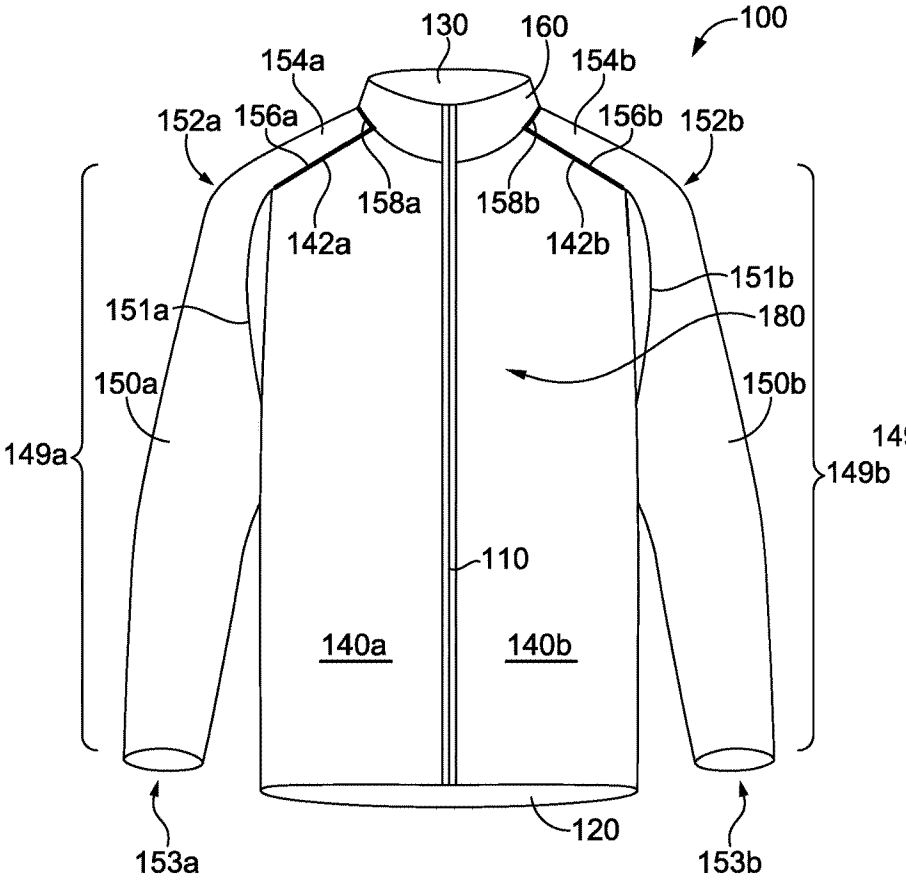

FIGS. 1A and 1B respectively depict a front view of an outer layer of an upper body garment 100 and a back view of the outer layer of the upper body garment 100 having sleeve assembly 149*a* and sleeve assembly 149*b*. Sleeve assembly 149*a* is comprised of an outer sleeve 150*a* (as shown and discussed with respect to FIGS. 1A-2B) and an inner sleeve 310*a* (as shown and discussed with respect to FIGS. 3A and 3B), and sleeve assembly 149*b* is comprised of an outer sleeve 150*b* (as shown and discussed with respect to FIGS. 1A-2B) and an inner sleeve 310*b* (as shown as shown and discussed with respect to FIGS. 3A and 3B). As further shown in FIG. 1A, the upper body garment 100 may be a full zip-up jacket having a slider mechanism 110 extending from a waist opening 120 to a neck opening 130. Although depicted and described as a zip-up jacket, it is also contemplated herein that the upper body garment 100 may be in the form of a pullover shirt, a hoodie, and the like.

The front of the upper body garment 100 includes an outer front panel 140*a* and an outer front panel 140*b*. As shown in FIG. 1B, the upper body garment 100 further includes an outer back panel 170 that when attached to the outer front panels 140*a* and 140*b*, form an outer torso portion 180 of the upper body garment 100. The upper body garment 100 further includes an outer sleeve 150*a* and an outer sleeve 150*b*. In example aspects, the outer torso portion 180 and the outer sleeves 150*a* and 150*b* may be formed of a tightly woven material to help provide wind resistance features to the upper body garment 100. It is also contemplated herein that the outer torso portion 180 and the outer sleeves 150*a* and 150*b* may be treated with, for example, a durable water repellant to impart water resistant and/or water repellant properties to the material helping to protect a wearer from, for example, rain, sleet, snow, and the like.

Each outer sleeve 150*a* and 150*b* includes a respective proximal end 152*a* and 152*b* and a respective distal end 153*a* and 153*b*. Each of the proximal ends 152*a* and 152*b* of the respective outer sleeve 150*a* and the outer sleeve 150*b* includes a respective shoulder portion extension 154*a* and 154*b* that continuously extends from the respective proximal ends 152*a* and 152*b* in a direction toward the neck opening 130. A front edge 156*a* of the shoulder portion extension 154*a* abuts and is attached to a front upper edge 142*a* of the outer front panel 140*a*, and a front edge 156*b* of the shoulder portion extension 154*b* abuts and is attached to a front upper edge 142*b* of the outer front panel 140*b*. A terminal edge 158*a* of the shoulder portion extension 154*a* may abut and be attached to a collar 160 of upper body garment 100, and similarly, a terminal edge 158*b* of the shoulder portion extension 154*b* may also abut and be attached to the collar 160 of upper body garment 100. It is also contemplated herein that when the upper body garment 100 does not include the collar 160, the terminal edges 158*a* and 158*b* may form part of the neck opening 130 of the upper body garment 100.

In the back view of the upper body garment 100, a back edge 157*a* of the shoulder portion extension 154*a* abuts and is attached to a back upper edge 172*a* of the outer back panel 170, and a back edge 157*b* of the shoulder portion extension 154*b* abuts and is attached to a back upper edge 172*b* of the outer back panel 170. The outer sleeve 150*a* includes an armhole perimeter 151*a*, and the outer sleeve 150*b* includes an armhole perimeter 151*b*. In example aspects, the armhole perimeters 151*a* and 151*b* are fully detached from the outer torso portion 180 of the upper body garment 100. Thus, in example aspects, each outer sleeve 150*a* and 150*b* is attached to the outer torso portion 180 only by the shoulder portion extensions 154*a* and 154*b*, which are attached to the outer torso portion 180 of the upper body garment 100 by at least the front edges 156*a* and 156*b*, and the back edges 157*a* and 157*b*, thereby leaving the armhole perimeters 151*a* and 151*b* fully detached from the outer torso portion 180 of the upper body garment 100.

Figure 2A:
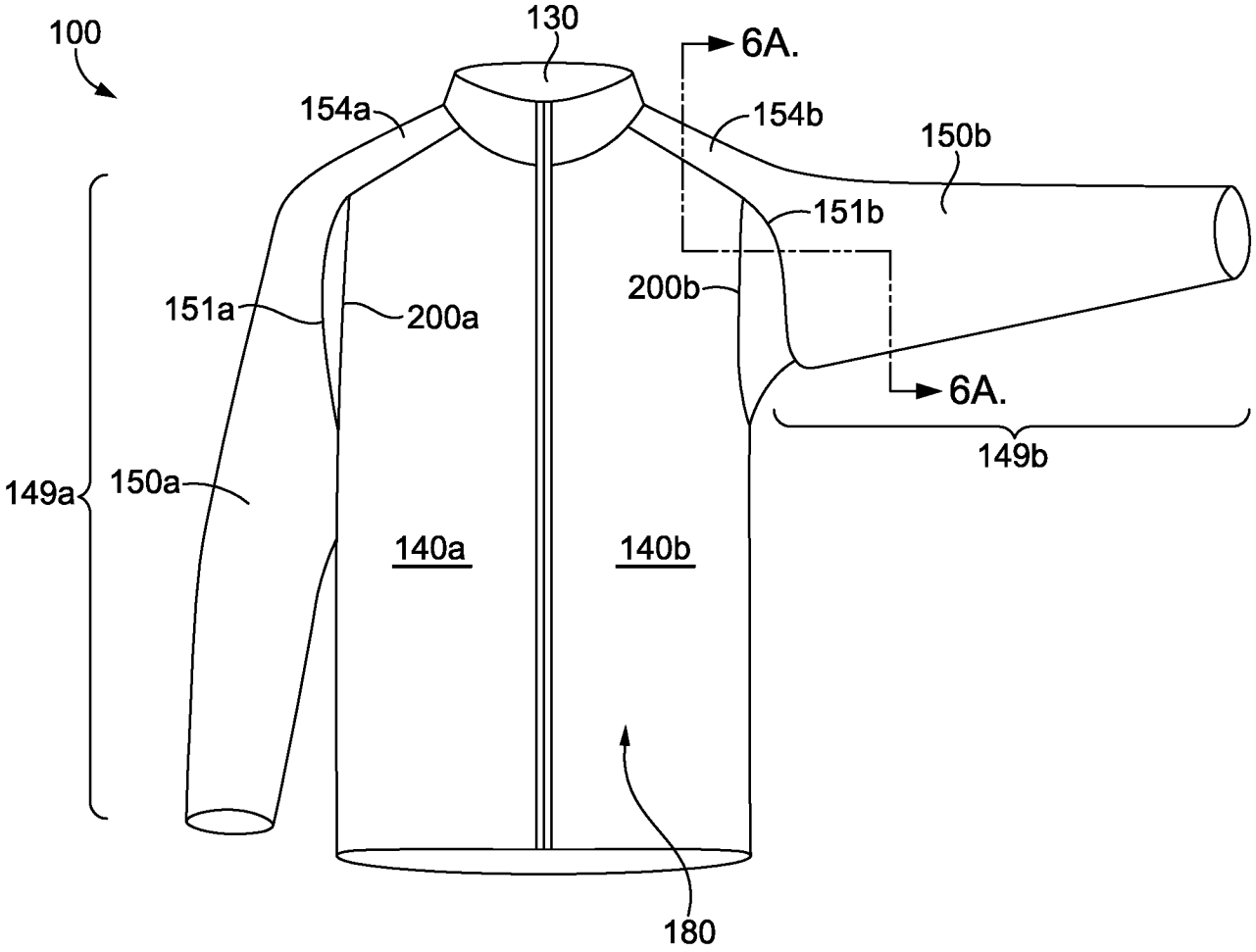
FIGS. 2A and 2B show a front and back view, respectively, of the upper body garment of FIGS. 1A and 1B with one of the sleeves extended, in accordance with aspects herein.
Figure 2B:
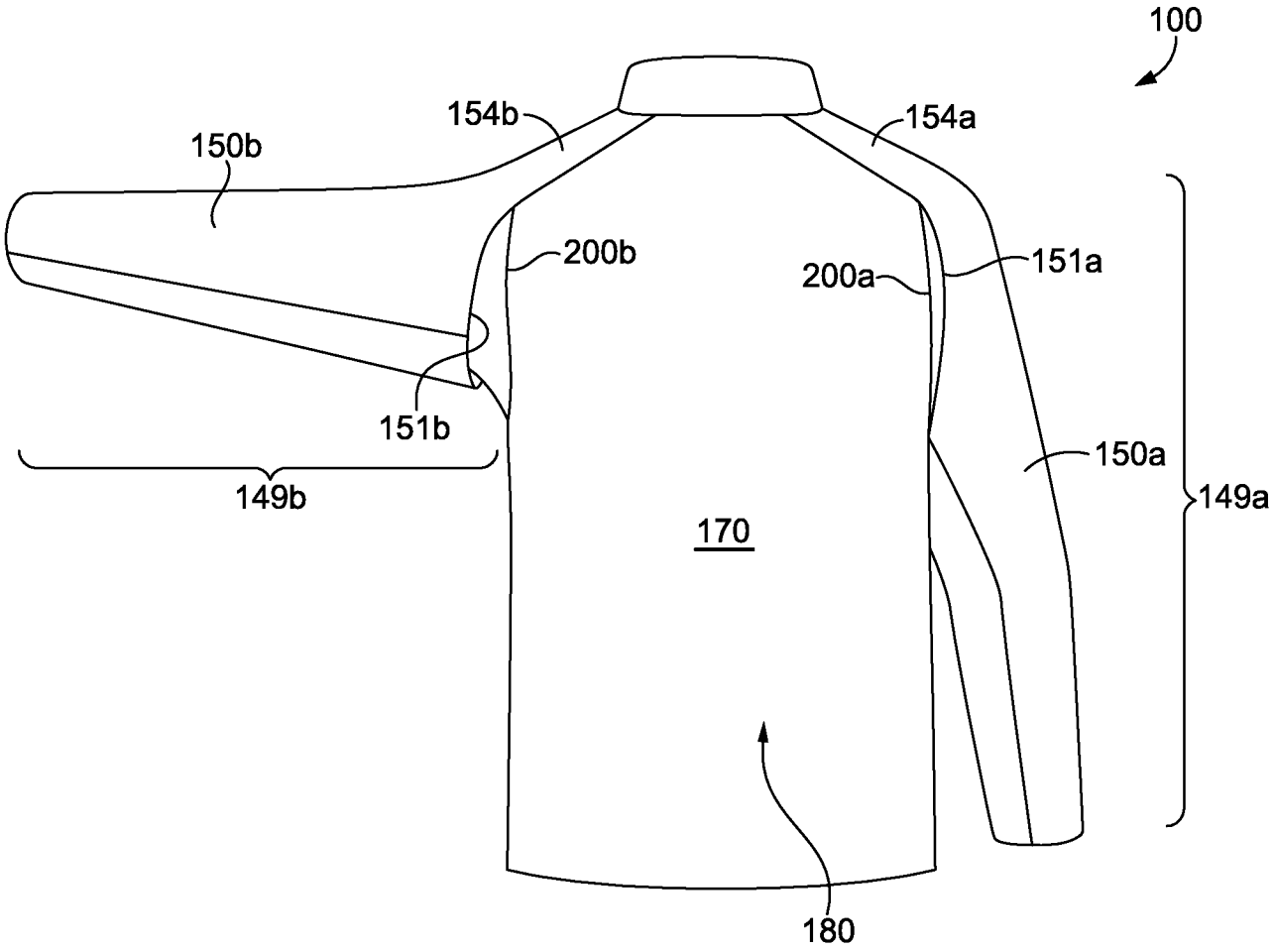

FIGS. 2A and 2B depict the upper body garment 100 with the outer sleeve 150*b* in an extended position to more clearly show the armhole perimeter 151*b* being fully detached from the outer torso portion 180 of the upper body garment 100. More specifically, the outer front panels 140*a* and 140*b* and the outer back panel 170 define outer sleeve opening edges 200*a* and 200*b* respectively. In example aspects, the armhole perimeters 151*a* and 151*b* are fully detached from the respective outer sleeve opening edges 200*a* and 200*b*.

Figure 3B:
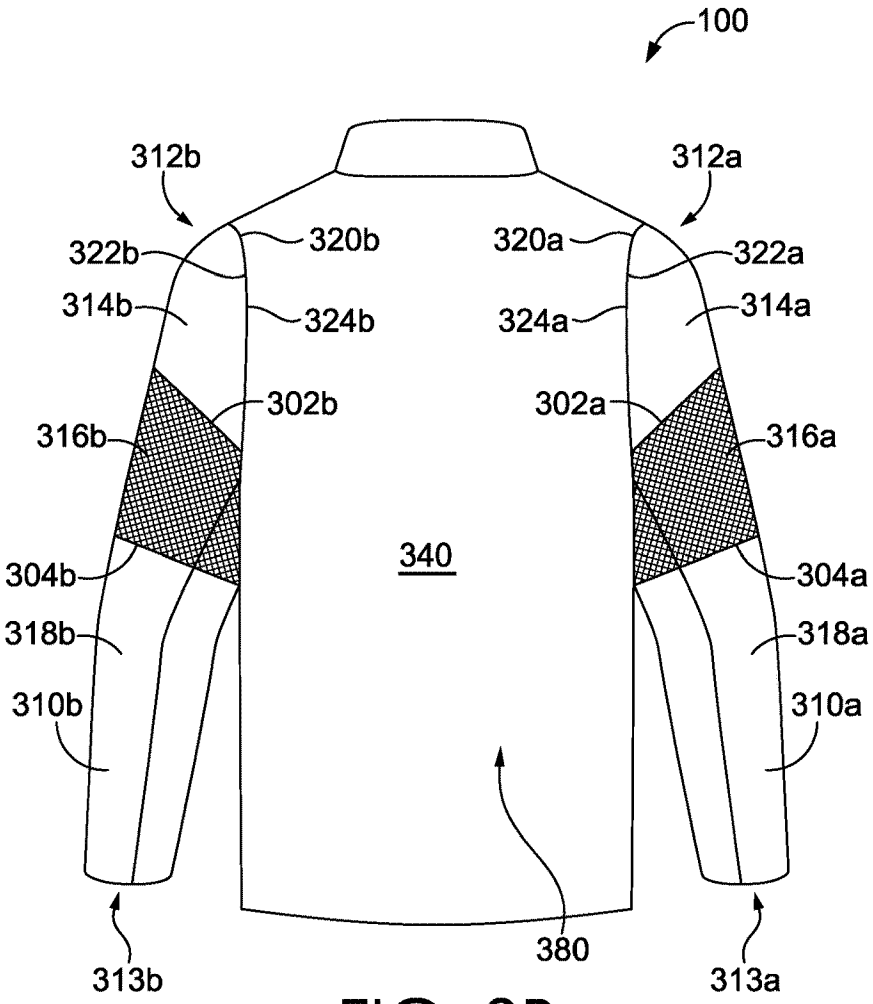
FIGS. 3A and 3B show a front and back view, respectively, of inner layers of the upper body garment of FIGS. 1A and 1B, in accordance with aspects herein.
Figure 3A:
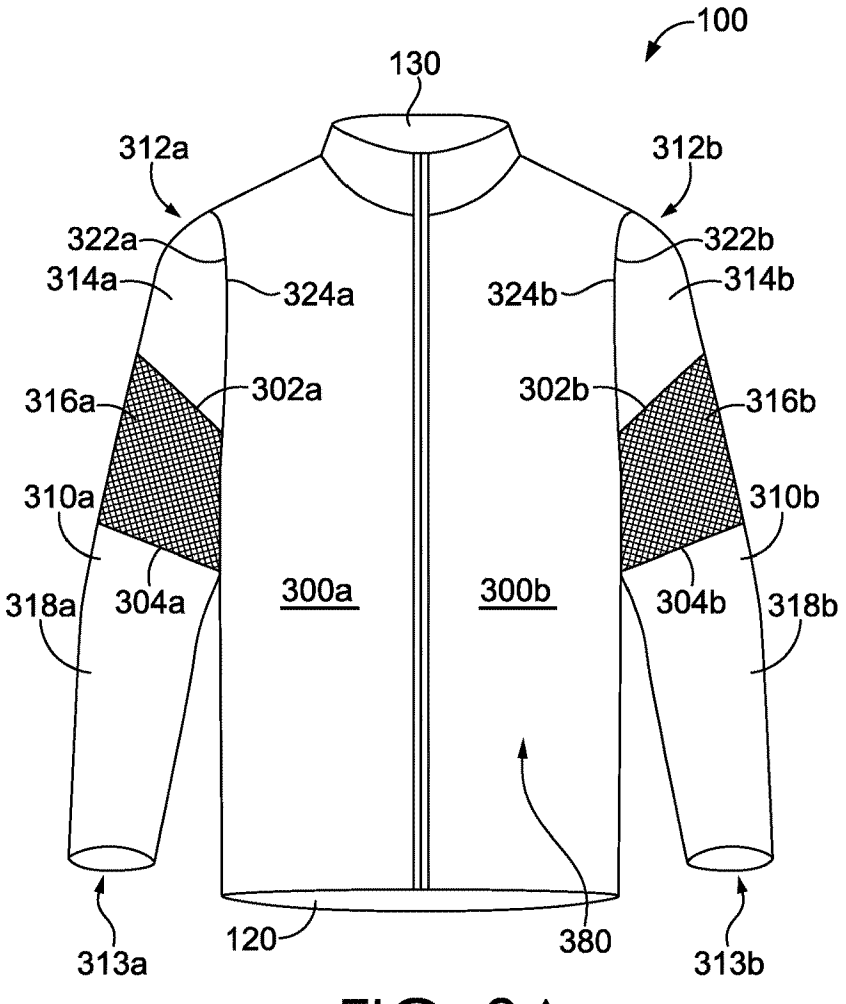

A front view of an inner layer of the upper body garment 100 is shown in FIG. 3A, and a back view of the inner layer of the upper body garment 100 is shown in FIG. 3B. The front of the upper body garment 100 includes an inner front panel 300*a* and an inner front panel 300*b*, and the back of the upper body garment 100 includes an inner back panel 340. When the inner back panel 340 and the inner front panels 300*a* and 300*b* are attached, they form an inner torso portion 380 of the upper body garment 100. The inner front panels 300*a* and 300*b* and the inner back panel 340 may be formed from a tightly woven or knit material, similar to the one used for the outer torso portion 180 to enhance the wind resistance of the upper body garment 100. Alternatively, the inner front panels 300*a* and 300*b* may be formed from a comfort knit or woven textiles such as a cotton based textile, or moisture management knit or woven textiles, and the like. Depending on the type of material(s) used for the inner front panels 300*a* and 300*b*, and the inner back panel 340, the inner front panels 300*a* and 300*b* may exhibit some stretch properties. In other words, the inner front panels 300*a* and 300*b* and the inner back panel 340 may have a higher degree of stretch than the outer front panels 140*a* and 140*b* and the outer back panel 170 in some example aspects.

The upper body garment 100 also includes an inner sleeve 310*a* and an inner sleeve 310*b*. Each inner sleeve 310*a* and 310*b* includes a respective proximal end 312*a* and 312*b* and a respective distal end 313*a* and 313*b*. In one example aspect, each of the proximal ends 312*a* and 312*b* of the respective inner sleeves 310*a* and 310*b* do not include a respective shoulder portion extension as shown thus forming generally circumferential perimeter edges 322*a* and 322*b*. In another example aspect, each of the proximal ends 312*a* and 312*b* of the respective inner sleeve 310*a* and the inner sleeve 310*b* includes a shoulder portion extension (not shown) thus forming a generally non-circumferential perimeter edge (similar to the outer sleeves 150*a* and 150*b*). In either example aspect, the perimeter edges 322*a* and 322*b* abut and are fully attached to corresponding inner sleeve opening edges 324*a* and 324*b* formed when the inner front panels 300*a* and 300*b* are attached to the inner back panel 340. In example aspects, the perimeter edges 322*a* and 322*b* of the respective proximal ends 312*a* and 312*b* also abut and are fully attached to the corresponding outer sleeve opening edges 200*a* and 200*b* formed when the outer front panels 140*a* and 140*b* are attached to the outer back panel 170, as seen in FIGS. 2A and 2B.

The inner sleeves 310*a* and 310*b* may each include a plurality of portions. In the particular example shown in FIGS. 3A and 3B, each of the inner sleeves 310*a* and 310*b* includes an upper sleeve portion 314*a* and 314*b*, a lower sleeve portion 318*a* and 318*b*, and an intermediate sleeve portion 316*a* and 316*b*, which is located between the upper sleeve portions 314*a* and 314*b* and the lower sleeve portions 318*a* and 318*b*.

In example aspects, the upper sleeve portions 314*a* and 314*b* are formed of the same material as the outer sleeves 150*a* and 150*b*, so that the upper sleeve portions 314*a* and 314*b* provide the same protection from environmental elements to the wearer as provided by the outer sleeves 150*a* and 150*b*. For instance, the upper sleeve portions 314*a* and 314*b* may be formed of a woven material having water repellant and/or water resistant properties. This may be important, because as shown in FIGS. 2A and 2B, the upper sleeve portions 314*a* and 314*b* of the inner sleeves 310*a* and 310*b* may be exposed when the wearer, for example, extends his or her arms to the front, sides, back, or raises his or her arms up. For example, in FIGS. 2A and 2B, the outer sleeve 150*a* is positioned downward, minimally exposing the upper sleeve portion 314*a*, and the outer sleeve 150*b* is extended to the side, thereby exposing a greater area of the upper sleeve portion 314*b*.

The intermediate sleeve portions 316*a* and 316*b* are located between and abut both the upper sleeve portions 314*a* and 314*b* and the lower sleeve portions 318*a* and 318*b*. In other words, a distal end of the upper sleeve portions 314*a* and 314*b* is attached to a proximal end of the intermediate sleeve portions 316*a* and 316*b* at seams 302*a* and 302*b*. A distal end of the intermediate sleeve portions 316*a* and 316*b* is attached to a proximal end of the lower sleeve portions 318*a* and 318*b* at seams 304*a* and 304*b*. In example aspects, the intermediate sleeve portions 316*a* and 316*b* may be formed of stretch materials such as, for example, elastane, stretch mesh, and the like, that have higher stretch properties than other portions of the upper body garment 100. The stretch properties of the intermediate sleeve portions 316*a* and 316*b* allow the inner sleeves 310*a* and 310*b* to accommodate the wearer's shoulder and arm motions, which are not restricted by the outer sleeves 150*a* and 150*b* because the outer sleeves 150*a* and 150*b* are detached from the outer sleeve opening edges 200*a* and 200*b* (see FIGS. 2A and 2B). In other words, the intermediate sleeve portions 316*a* and 316*b* afford the inner sleeves 310*a* and 310*b* room to elongate as necessary, independent of the outer sleeves 150*a* and 150*b* when the wearer is engaged in an activity that requires movement of her shoulders.

Figure 4:
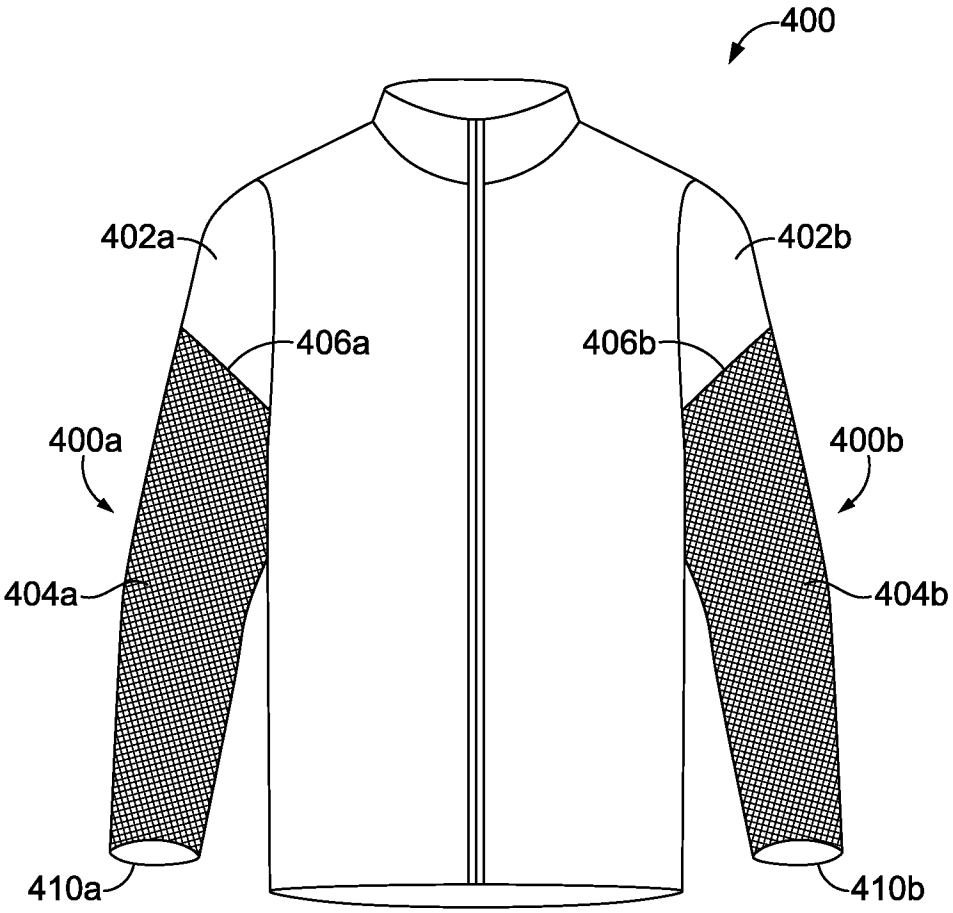
FIG. 4 shows a front view of an alternate inner sleeve construction for the upper body garment, in accordance with aspects herein.

In example aspects, the lower sleeve portions 318*a* and 318*b* may be formed from the same materials as the inner front panels 300*a* and 300*b* and the inner back panel 340. In other example aspects, the lower sleeve portions 318*a* and 318*b* may be formed from a material that has intermediate stretch properties, meaning that is less stretchable than the intermediate sleeve portions 316*a* and 316*b*, but is more stretchable than the inner front panels 300*a* and 300*b* and/or the inner back panel 340. In other example aspects, the lower sleeve portions 318*a* and 318*b* may have the same stretch properties as the intermediate sleeve portions 316*a* and 316*b*, or may even continuously extend (i.e., no seams between the distal ends of the intermediate sleeve portions 316*a* and 316*b* and the proximal ends of the lower sleeve portions 318*a* and 318*b*) from the intermediate sleeve portions 316*a* and 316*b*, as shown in FIG. 4. In FIG. 4, an upper body garment 400 includes inner sleeves 400*a* and 400*b*. Each of the inner sleeves 400*a* and 400*b* includes an upper sleeve portion 402*a* and 402*b* respectively and a lower sleeve portion 404*a* and 404*b* respectively, where a proximal end of the lower sleeve portions 404*a* and 404*b* abuts and is attached to a distal end of the upper sleeve portions 402*a* and 402*b* at seams 406*a* and 406*b*, and continuously extends to distal ends 410*a* and 410*b* of the inner sleeves 400*a* and 400*b*. In this example, the entire lower sleeve portions 404*a* and 404*b* may be more stretchable than other portions of the upper body garment 400.

Figure 5:
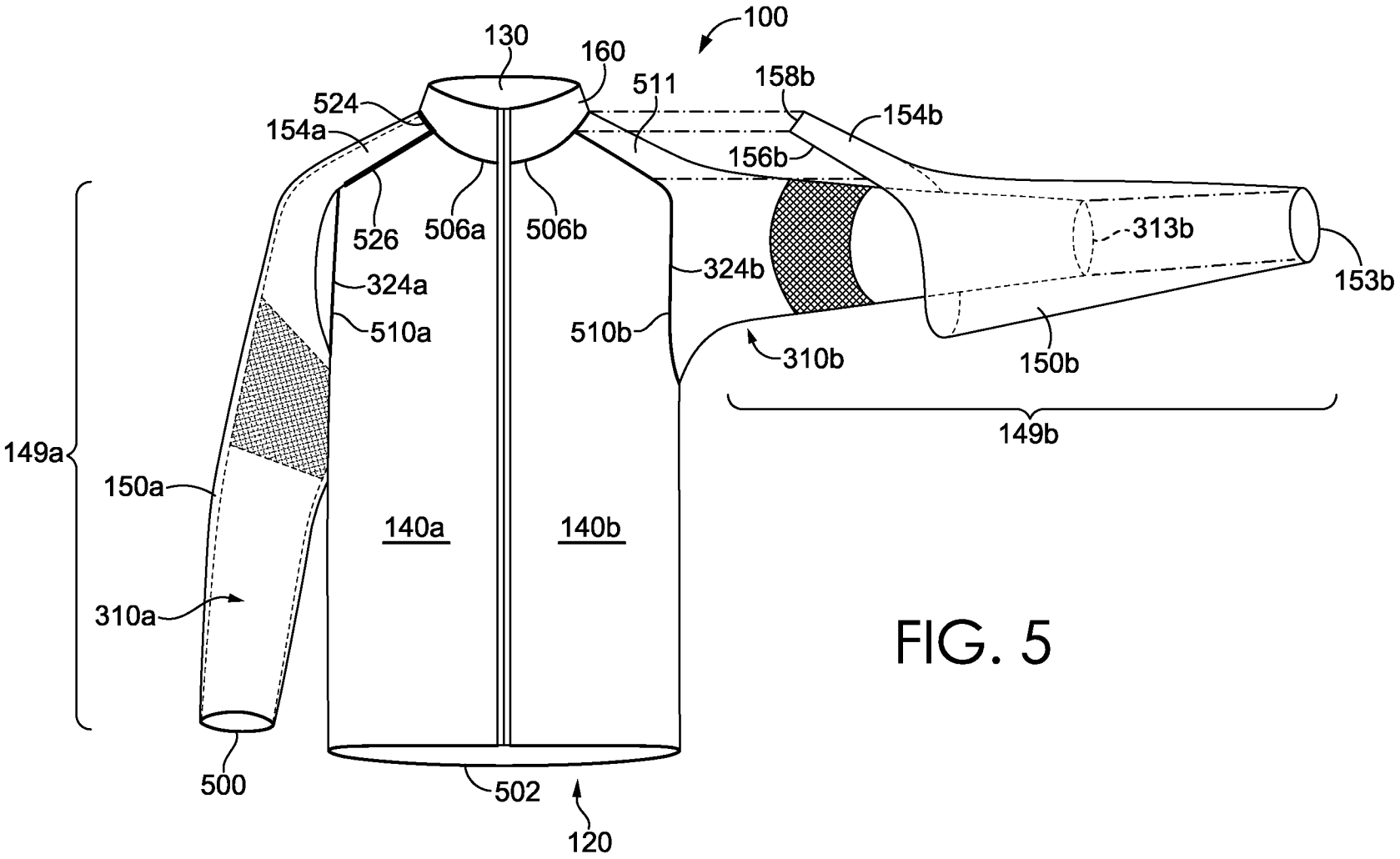
FIG. 5 shows a partially deconstructed view of the upper body garment of FIG. 1A, in accordance with aspects herein.

FIG. 5 depicts a semi-deconstructed view of the upper body garment 100 having the sleeve assembly 149*a* and the sleeve assembly 149*b*. As shown, the inner sleeves 310*a* and 310*b* of the sleeve assemblies 149*a* and 149*b*, respectively, fully extend through the outer sleeves 150*a* and 150*b*, of the sleeve assemblies 149*a* and 149*b*, respectively. In example aspects, the distal ends 313*a* and 313*b* of the inner sleeves 310*a* and 310*b* are secured or attached to the distal ends 153*a* and 153*b* of the outer sleeves 150*a* and 150*b*, shown as attachment 500. Further, the proximal ends 312*a* and 312*b* of the inner sleeves 310*a* and 310*b* may comprise inner shoulder portion extensions 511.

As further shown, various other inner portions are secured to various other outer portions of the upper body garment 100. For example, the inner back panel 340, the outer back panel 170, the inner front panels 300*a* and 300*b*, and the outer front panels 140*a* and 140*b* may be secured to each other at attachment 502, which defines the waist opening 120 of the upper body garment 100. The inner back panel 340, the outer back panel 170, the inner front panels 300*a* and 300*b*, and the outer front panels 140*a* and 140*b* may also be secured to each other at attachments 506*a* and 506*b* that define the neck opening 130. Reference numerals 510*a* and 510*b* indicate the attachment of the proximal ends 312*a* and 312*b* of the inner sleeves 310*a* and 310*b* to both the inner sleeve opening edges 324*a* and 324*b* and the outer sleeve opening edges 200*a* and 200*b* both on the front and the back of the upper body garment 100.

As further shown in FIG. 5, for each of the outer sleeves 150*a* and 150*b*, only the terminal edges 158*a* and 158*b* of the shoulder portion extensions 154*a* and 154*b* are attached to the collar 160 by attachment 524, only the front edges 156*a* and 156*b* of the shoulder portion extensions 154*a* and 154*b* are attached to the outer front panels 140*a* and 140*b* by attachment 526, and only the corresponding back edges 157*a* and 157*b* of the shoulder portion extensions 154*a* and 154*b* are attached to the outer back panel 170 by a corresponding attachment (not shown here, but viewable in FIG. 1B). Thus, in summary, the outer sleeves 150*a* and 150*b* of the upper body garment 100 are attached to the rest of the upper body garment 100 only by the respective shoulder portion extensions 154*a* and 154*b*, and the respective attachments 500 at the respective distal ends 153*a* and 153*b* of the outer sleeves 150*a* and 150*b*. The attachments 500 serve to keep the respective inner sleeves 310*a* and 310*b* and the respective outer sleeves 150*a* and 150*b* in a lengthwise correspondence when the wearer dons or doffs the upper body garment 100, when the wearer engages in an activity requiring motion, and in any other situation such as when the wearer wants to pull his sleeves up or down. In other words, the attachments 500 prevent the inner sleeves 310*a* and 310*b* from "riding up" or being pulled proximally during different wearer movements.

Figure 6B:
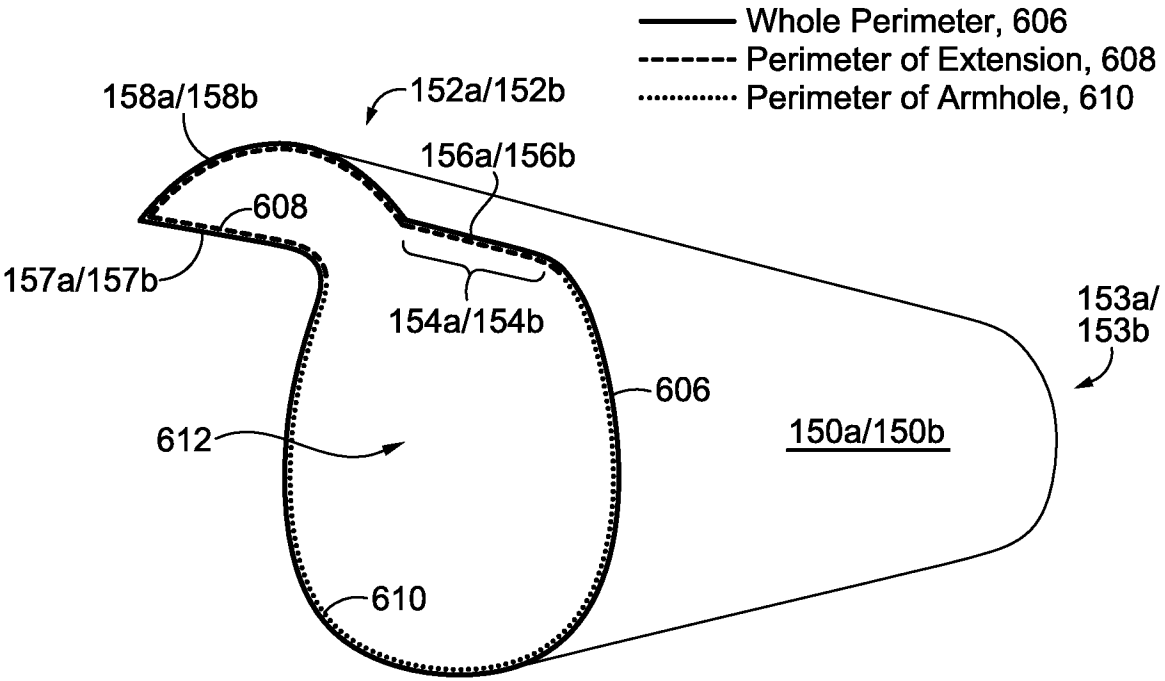
FIG. 6B shows a perspective view of an outer sleeve portion of the upper body garment of FIGS. 1A and 1B, in accordance with aspects herein.
Figure 6A:
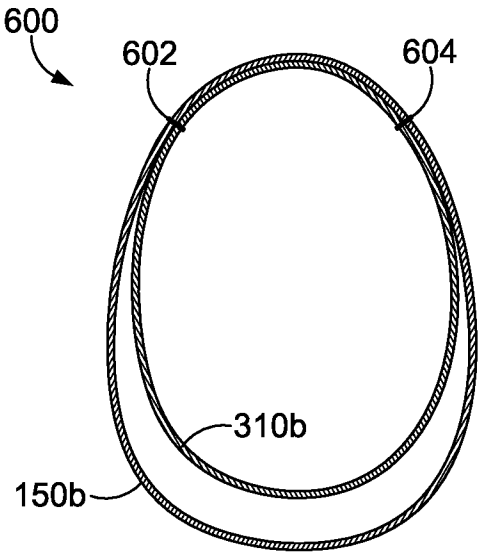
FIG. 6A shows a cross-sectional view taken from the garment sleeve shown in FIG. 2A through cut line 6A-6A, in accordance with aspects herein.

FIG. 6A depicts a cross sectional view 600 of the outer sleeve 150*b* taken along the line 6A-6A in FIG. 2A showing how the outer sleeve 150*b* encircles the inner sleeve 310*b*. Reference numerals 602 and 604 indicate attachments where the shoulder portion extension 154*b* is attached to the outer front panel 140 at the front upper edge 142*b* and to the outer back panel 170 at the back upper edge 172*b*. FIG. 6B depicts a perspective view of the proximal end 152*b* of the outer sleeve 150*b*. The proximal end 152*b* of the outer sleeve 150*b* (and also for the outer sleeve 150*a*) generally defines a non-circumferential perimeter edge 606. Described differently, the non-circumferential perimeter edge 606 includes a perimeter 608 of the shoulder portion extension 154*b* and a circumferential perimeter 610 defining an armhole opening 612. The arrangement of the outer sleeves 150*a* and 150*b* with the respective inner sleeves 310*a* and 310*b* provides the structural elements that enhance mobility to the arms and shoulders of the wearer when wearing the upper body garment 100.

Figure 7B:
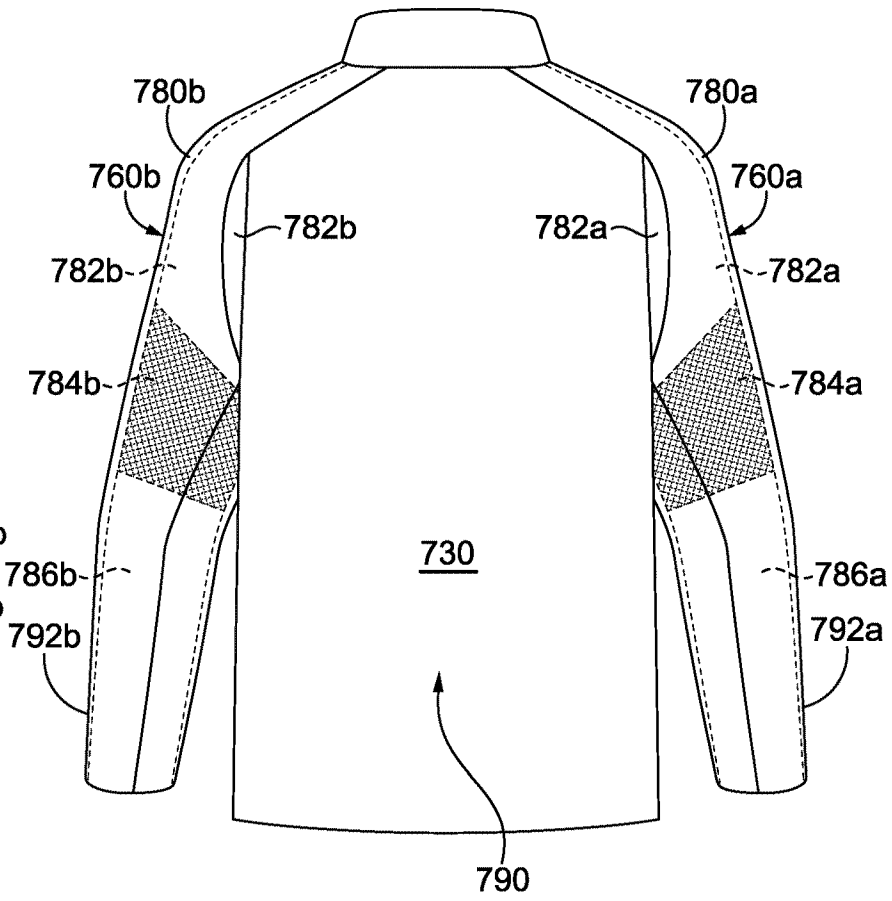
FIGS. 7A and 7B show a different example upper body garment, in accordance with aspects herein.
Figure 7A:
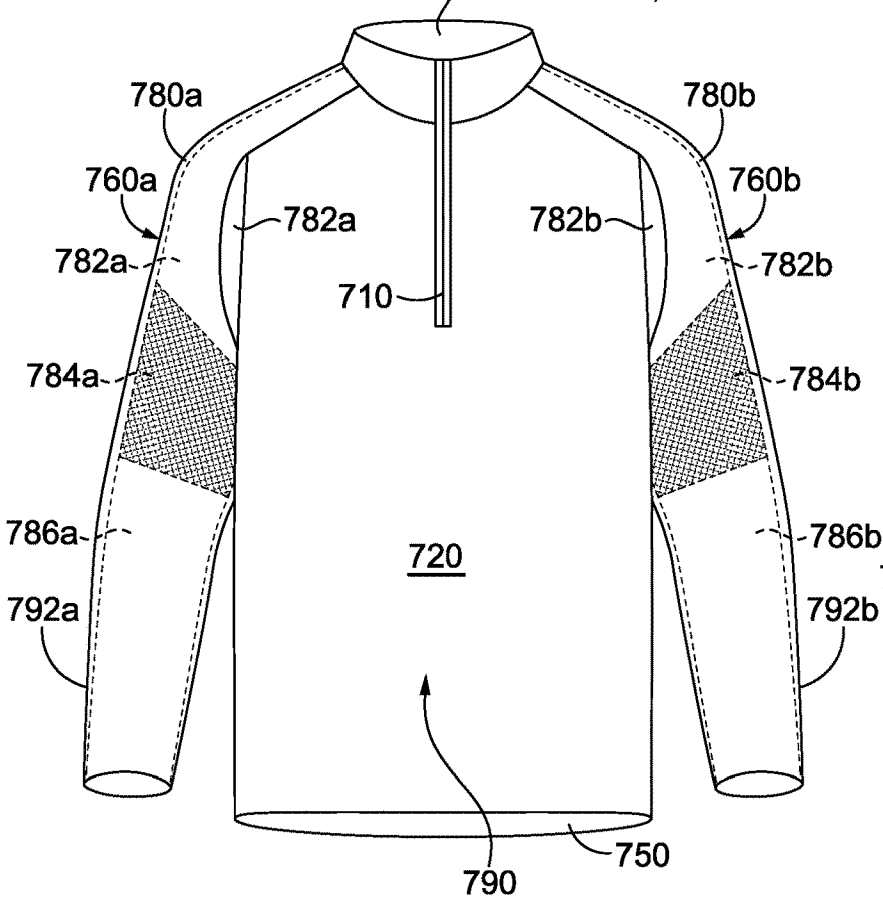

FIGS. 7A and 7B depict an alternative example upper body garment 700. The upper body garment 700 has a pullover configuration where an optional closure mechanism 710 extends only partially along the length of a front panel 720, where the front panel 720 extends from a neck opening 740 to a waist opening 750. Other than the type of garment construction (e.g., pullover versus jacket), the construction of the upper body garment 700 may be the same as the upper body garment 100, particularly in regards to the sleeve configuration. The upper body garment 700 includes a front panel 720 and a back panel 730 that together form a torso portion 790. The upper body garment 700 further includes a pair of sleeves 792*a* and 792*b*, where each of the sleeves 792*a* and 792*b* includes an outer sleeve 760*a* and 760*b* and an inner sleeve 780*a* and 780*b*. Further, each inner sleeve 780*a* and 780*b* includes an upper sleeve portion 782*a* and 782*b*, an optional intermediate sleeve portion 784*a* and 784*b*, and a lower sleeve portion 786*a* and 786*b* with the optional intermediate sleeve portions 784*a* and 784*b* and/or the lower sleeve portions 786*a* and 786*b* (when the sleeve is configured as in FIG. 4), having a greater elasticity or being more stretchable than other portions of the upper body garment 700.

Further, although not shown, it is contemplated that the torso portion of the upper body garment 100 or the upper body garment 700 may be formed from a single layer of material rather than having an outer layer and an inner layer. In other words, rather than having the inner front panels 300*a* and/or 300*b* and the inner back panel 340, the outer torso portion 180 of the upper body garment 100 would only include the outer front panels 140*a* and 140*b* and the outer back panel 170. Similarly, the upper body garment 700 would only include the front panel 720 and the back panel 730 in the torso portion 790. Furthermore, it is also contemplated that the upper body garments 100 and/or 700, may include thermal insulation between the inner and outer panels for colder weather conditions. As well, the outer sleeves may optionally also include thermal insulation in addition to the torso portion of the upper body garment 100 or the upper body garment 700.

Figure 8:
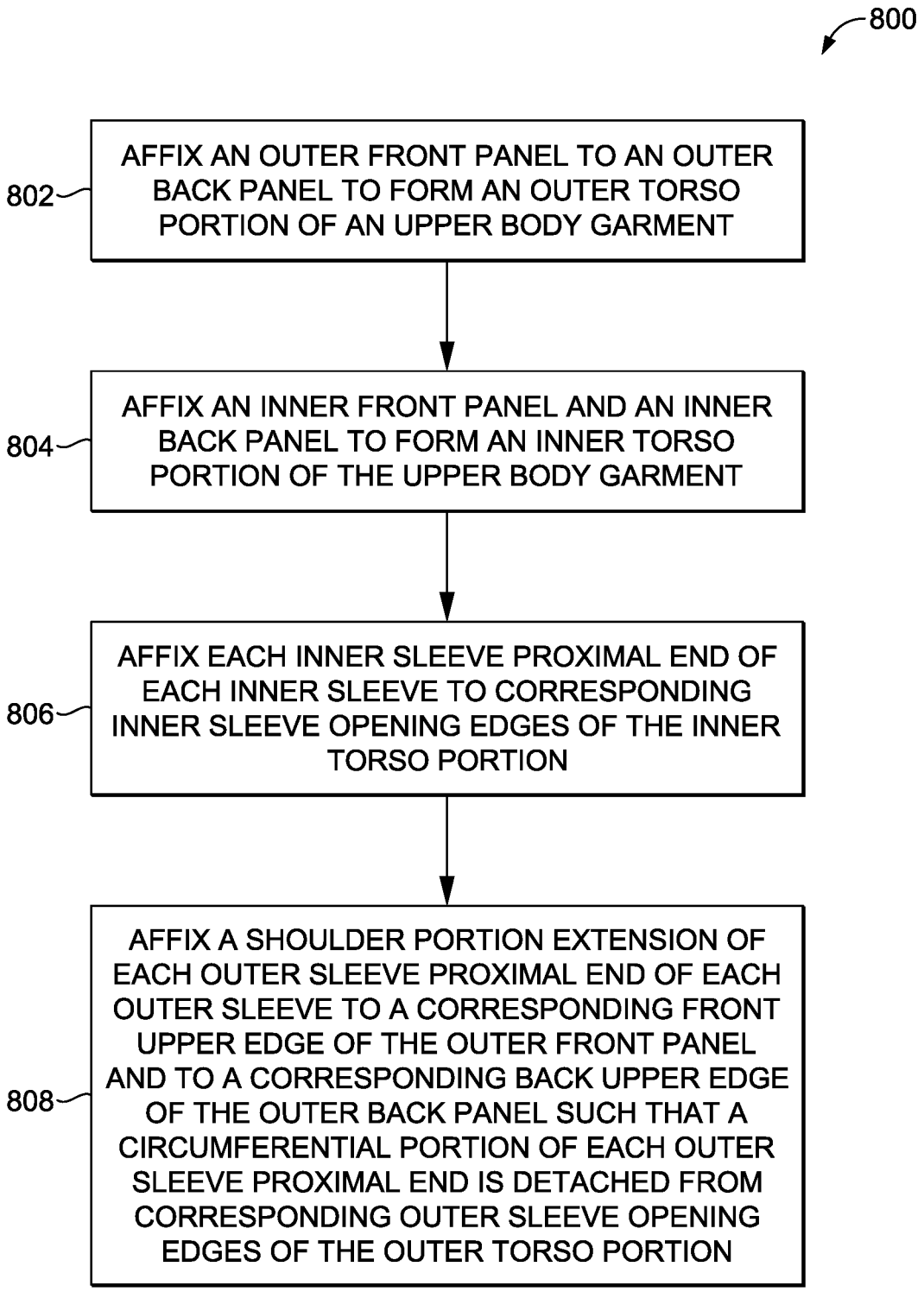
FIG. 8 shows a flow diagram outlining the steps for a method of manufacturing an upper body garment, in accordance with aspects herein.

FIG. 8 is a flow diagram of an example method of manufacturing the upper body garments shown in FIGS. 1A to 7B, and is referenced generally by the numeral 800. At step 802, an outer front panel is attached to an outer back panel to form an outer torso portion of the upper body garment in accordance with aspects herein. At step 804, an inner front panel and an inner back panel are attached to form an inner torso portion of the upper body garment. At step 806, a pair of inner sleeves are attached to the inner torso portion of the upper body garment by attaching a proximal end of each inner sleeve to corresponding inner sleeve opening edges of the inner torso portion. The proximal ends of each inner sleeve may also be attached to corresponding outer sleeve opening edges of the outer torso portion. At step 808, each outer sleeve is attached to the outer torso portion of the upper body garment by attaching a shoulder portion extension of each outer sleeve proximal end to a corresponding front upper edge of the outer front panel and to a corresponding back upper edge of the outer back panel, such that a circumferential portion of each outer sleeve proximal end is detached from the corresponding outer sleeve opening edges of the outer torso portion.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

Having thus described the invention, what is claimed is:

1. An upper body garment comprising:

an outer front panel and an outer back panel forming an outer torso portion of the upper body garment, the outer front panel and the outer back panel including an outer sleeve opening edge;

an inner front panel and an inner back panel forming an inner torso portion of the upper body garment, the inner front panel and the inner back panel including an inner sleeve opening edge; and a sleeve assembly comprising:

an inner sleeve having an inner sleeve proximal end and an inner sleeve distal end, the inner sleeve proximal end attached to the inner sleeve opening edge and the outer sleeve opening edge, and an outer sleeve having an outer sleeve proximal end and an outer sleeve distal end, the outer sleeve proximal end attached to a front upper edge of the outer front panel and to a back upper edge of the outer back panel, wherein the outer sleeve proximal end is detached from the outer sleeve opening edge.

2. The upper body garment of claim 1, wherein the inner sleeve distal end is attached to the outer sleeve distal end.

3. The upper body garment of claim 1, wherein the inner sleeve includes an intermediate sleeve portion that exhibits a stretch characteristic, wherein the intermediate sleeve portion is spaced apart from the inner sleeve proximal end and the inner sleeve distal end.

4. The upper body garment of claim 3, wherein the intermediate sleeve portion includes a stretch mesh material.

5. The upper body garment of claim 1, wherein the outer torso portion and the outer sleeve are made from a water resistant or a water repellant material.

6. The upper body garment of claim 1, wherein the outer sleeve proximal end includes a non-circumferential perimeter edge.

7. The upper body garment of claim 1, wherein the outer sleeve proximal end includes an outer shoulder portion extension and an outer circumferential portion, wherein the outer shoulder portion extension attaches to the front upper edge of the outer front panel and to the back upper edge of the outer back panel, and wherein the outer circumferential portion is detached from the outer sleeve opening edge.

8. The upper body garment of claim 7, wherein the inner sleeve proximal end includes an inner shoulder portion extension and an inner circumferential portion, wherein the inner shoulder portion extension attaches to a front upper edge of the inner front panel and to a back upper edge of the inner back panel, and wherein the inner circumferential portion is attached to the inner sleeve opening edge.

9. The upper body garment of claim 1, wherein the inner sleeve includes an upper sleeve portion extending from the inner sleeve proximal end, a lower sleeve portion extending from the inner sleeve distal end, and an intermediate sleeve portion positioned between the upper sleeve portion and the lower sleeve portion, wherein the intermediate sleeve portion has a greater stretch characteristic than the upper sleeve portion.

10. The upper body garment of claim 9, wherein the outer torso portion, the outer sleeve, and the upper sleeve portion of the inner sleeve are made from a water resistant or a water repellant material.

11. An upper body garment comprising:

a torso portion having a front panel and a back panel cooperating to form a first sleeve opening having a first sleeve opening edge; and a first sleeve assembly comprising:

a first inner sleeve having a first inner sleeve proximal end and a first inner sleeve distal end, the first inner sleeve proximal end fully attached to the first sleeve opening edge, and a first outer sleeve having a first outer sleeve proximal end and a first outer sleeve distal end, the first outer sleeve proximal end including a first outer shoulder portion extension and a first outer circumferential portion, the first outer shoulder portion extension attached to a first shoulder area of the torso portion, and the first outer circumferential portion being fully detached from the first sleeve opening edge.

12. The upper body garment of claim 11 further comprising:

a second sleeve assembly comprising:

a second inner sleeve having a second inner sleeve proximal end and a second inner sleeve distal end, the second inner sleeve proximal end fully attached to a second sleeve opening edge of a second sleeve opening of the torso portion; and a second outer sleeve having a second outer sleeve proximal end and a second outer sleeve distal end, the second outer sleeve proximal end including a second outer shoulder portion extension and a second outer circumferential portion, the second outer shoulder portion extension attached to a second shoulder area of the torso portion, and the second outer circumferential portion being fully detached from the second sleeve opening edge.

13. The upper body garment of claim 12, wherein the first inner sleeve distal end is attached to the first outer sleeve distal end, and wherein the second inner sleeve distal end is attached to the second outer sleeve distal end.

14. The upper body garment of claim 12, wherein the second inner sleeve includes a second upper sleeve portion extending from the second inner sleeve proximal end, a second lower sleeve portion extending from the second inner sleeve distal end, and a second intermediate sleeve portion positioned between the second upper sleeve portion and the second lower sleeve portion, wherein the second intermediate sleeve portion has a greater stretch characteristic than the second upper sleeve portion.

15. The upper body garment of claim 11, wherein the first inner sleeve includes a first upper sleeve portion extending from the first inner sleeve proximal end, a first lower sleeve portion extending from the first inner sleeve distal end, and a first intermediate sleeve portion positioned between the first upper sleeve portion and the first lower sleeve portion, wherein the first intermediate sleeve portion has a greater stretch characteristic than the first upper sleeve portion.

16. The upper body garment of claim 15, wherein the first intermediate sleeve portion is comprised of a stretch mesh material.

17. The upper body garment of claim 15, wherein the torso portion, the first outer sleeve, and the first upper sleeve portion are comprised of a water proof or a water repellant material.

18. The upper body garment of claim 11, wherein the front panel and the back panel of the torso portion include two or more layers of material.

19. The upper body garment of claim 11, wherein the first inner sleeve proximal end includes a first inner shoulder portion extension and a first inner circumferential portion, wherein the first inner shoulder portion extension is attached to the first shoulder area of the torso portion, and wherein the first inner circumferential portion is attached to the first sleeve opening edge.

20. A method for manufacturing an upper body garment comprising:

attaching an outer front panel to an outer back panel to form an outer torso portion of the upper body garment, the outer torso portion including an outer sleeve opening edge;

attaching an inner front panel and an inner back panel to form an inner torso portion of the upper body garment, the inner torso portion including an inner sleeve opening edge; and fully attaching an inner sleeve proximal end of an inner sleeve to the inner sleeve opening edge; and attaching a shoulder portion extension of an outer sleeve proximal end of an outer sleeve to a front upper edge of the outer front panel and to a back upper edge of the outer back panel, wherein a circumferential portion of the outer sleeve proximal end is detached from the outer sleeve opening edge of the outer torso portion.

* * * * *